US008152960B2

(12) United States Patent
Schubert et al.

(10) Patent No.: US 8,152,960 B2
(45) Date of Patent: Apr. 10, 2012

(54) LIGNOCELLULOSIC FIBROUS MATERIAL MADE OF WOOD

(75) Inventors: Hans-Ludwig Schubert, Baienfurt (DE); Esa-Matti Aalto, Ravensburg (DE); Rudolf Patt, Reinbeck (DE); Othar Kordsachia, Oststeinbeck (DE); Christoph Storz, Glinde (DE)

(73) Assignee: Voith Patent GmbH, Heidenheim (DE)

( * ) Notice: Subject to any disclaimer, the term of this patent is extended or adjusted under 35 U.S.C. 154(b) by 518 days.

(21) Appl. No.: 12/161,646

(22) PCT Filed: Apr. 4, 2007

(86) PCT No.: PCT/EP2007/003013

§ 371 (c)(1),
(2), (4) Date: Jul. 21, 2008

(87) PCT Pub. No.: WO2007/140838

PCT Pub. Date: Dec. 13, 2007

(65) Prior Publication Data

US 2009/0229774 A1 Sep. 17, 2009

(30) Foreign Application Priority Data

Jun. 8, 2006 (DE) ..... 10 2006 027 005

(51) Int. Cl.
*D21H 11/00* (2006.01)

(52) U.S. Cl. ..... 162/141; 162/91

(58) Field of Classification Search ..... 162/91, 162/141, 26.1

See application file for complete search history.

(56) References Cited

U.S. PATENT DOCUMENTS

| | | | | |
|---|---|---|---|---|
| 3,382,149 | A * | 5/1968 | Hoh | 162/78 |
| 3,663,358 | A * | 5/1972 | Falkehag et al. | 162/70 |
| 6,273,994 | B1 * | 8/2001 | Creber et al. | 162/49 |
| 6,824,650 | B2 * | 11/2004 | Lindsay et al. | 162/168.2 |
| 6,923,887 | B2 * | 8/2005 | Pan | 162/6 |
| 2002/0129912 | A1 * | 9/2002 | Reinhard et al. | 162/78 |
| 2006/0266487 | A1 | 11/2006 | Scherb et al. | |

FOREIGN PATENT DOCUMENTS

| | | |
|---|---|---|
| CN | 1 388 287 | 1/2003 |
| CN | 1 455 046 | 11/2003 |
| EP | 1 316 639 A | 6/2003 |
| JP | 09 031880 | 2/1997 |

OTHER PUBLICATIONS

Pulp and Paper Manufacture, vol. 4:Sulfite Science and Technology, Ingruber et al. editor, The Joint Textbook Committee of the Paper Industry (1985) , third edition, pp. 159-212.*

Aikawagroup, Freeness conversion [online] Retrieved from the Internet [retrieved Aug. 9, 2010], no date, 2 pages <URL: http://www.aikawagroup.com/html/body_conversion1.html>.*

"Tearing Resistance of Paper" Note from WPS Analytical Lab, North Carolina State University [online] Retrieved from the Internet [retrieved Feb. 17, 2011], no date, pp. 5-25 to 5-36 <URL: http://cnr.ncsu.edu/wpsanalytical/documents/55Tearing.doc>.*

"Physical testing of pulp handsheets" TAPPI specification T220 sp-96, TAPPI (1996), pp. 1-6.*

Yamauchi et al, "Tearing test for paper using a tensile tester" J. Wood Sci. (2002) 48, pp. 532-535 [online] Retrieved from the Internet [retrieved Feb. 20, 2011] <URL: http://www.springerlink.com/content/m321255216551730/ >.*

Casey, James P., Pulp and Paper Chemistry and Chemical Technology, 3rd ed., vol. 3, John Wiley & Sons, 1981, pp. 1832-1833.*

N. Liebergott Und T. Joachimides: "Choosing the Best Brightening Process" Pulp & Paper Canada, vol. 80, 1979, XP009094432 cited in the application p. T39-p. T395 figure 1; table I.

* cited by examiner

*Primary Examiner* — Matthew Daniels
*Assistant Examiner* — Dennis Cordray
(74) *Attorney, Agent, or Firm* — Greenblum & Bernstein, P.L.C.

(57) ABSTRACT

The invention relates to a wood-based lignocellulosic fibrous material having a tearing length of more than 8 km at 15° SR and a lignin content of at least 15%, based on the unbleached oven-dry fibrous material, for coniferous wood and having a tearing length of more than 5.0 km at 20° SR and a lignin content of at least 12%, based on the unbleached oven-dry fibrous material, for deciduous wood.

16 Claims, No Drawings

LIGNOCELLULOSIC FIBROUS MATERIAL MADE OF WOOD

CROSS-REFERENCE TO RELATED APPLICATIONS

The present application is a U.S. National Stage of International Patent Application No. PCT/EP2007/003013 filed Apr. 4, 2007, and claims priority of German Patent Application No. 10 2006 027 005.3 filed Jun. 8, 2006. Moreover, the disclosure of International Patent Application No. PCT/EP2007/003013 is expressly incorporated by reference herein in its entirety.

BACKGROUND OF THE INVENTION

1. Field of the Invention

The invention relates to a wood-based lignocellulosic fibrous material.

2. Discussion of Background Information

Lignocellulosic fibers are used, inter alia, for the production of paper and paperboard. A large number of industrially produced lignocellulosic fibers are known, their properties differing greatly:

Groundwood designates fibers which are produced by mechanical defibering of the fiber composite by beating or grinding units. During the production of groundwood, barely any woody substance is broken down. The biomass originally used is found almost completely again in the groundwood. The production of groundwood requires a high use of energy. Newer processes for the production of groundwood attempt to improve the fiber characteristics and/or to reduce the energy demand by pre-treating the wood with steam and/or chemicals. These processes include, in particular, CTMP (chemo-pulp) and TMP (thermomechanical pulp). In the case of CTMP, in the industrial application, between 1 and 5% by weight of the chemicals, based on oven-dry wood, are normally used in order to permit partial dissolution of the fiber composite. Groundwood is generally characterized by low strength properties, in particular low tearing (breaking) length, and high opacity and light scattering with a low whiteness with a high tendency to yellowing.

Chemical pulp designates fibers which are produced by chemical dissolution of the fiber composite. During the production of chemical pulp, chemicals are used which normally act on the biomass under high pressure and high temperature. With more or less comprehensive removal of the lignin and part of the carbohydrates, that is to say with a significant loss in yield, fibers are produced which have good strength properties, in particular a high tearing length, and have a good ability to be bleached to a high whiteness and with a low tendency to yellowing. The energy required for the production of the chemical pulp is obtained from the waste liquor from the pulping.

The lignin content is often not critical for the use of the fibers. As a rule, the strength level is critical, since it often limits the areas of use. Numerous processes have therefore been developed which attempt to achieve a higher strength level, even for fibers with a higher lignin content, on the basis of processes for chemical pulp production.

Such a process, which has become established in practice in individual cases, is the NSSC process. By using extremely small quantities of sulfite, in the industrial application with neutral to slightly alkaline pH values, an attempt is made to achieve the highest possible strength of the fibers with the minimum breakdown of lignin. The quantities of chemicals are in practice kept as low as possible, since the process is operated without chemical recovery and, on account of the chemicals and the organic load which arises as a result of breakdown of the lignocellulosic material, produces a high effluent loading. Fibrous materials produced in accordance with the NSSC process are normally used unbleached.

Another process is the bisulfite process, which is operated at pH values around 4. Other processes, such as the kraft process (also called the sulfate process) or the soda process, which were developed and are used intrinsically for the production of chemical pulps with minimal lignin content, have also been checked for their suitability for the production of high-yield fibrous materials.

When checking suitability for such fibrous materials, the starting point is always practical experience that, on account of the high lignin content, the fiber in the unbeaten or in the little beaten state has only unsatisfactorily low strengths and the ability to be used economically is not provided. A good overview of high-yield fibrous materials is provided by "Choosing the best brightening process", N. Liebergott and J. Joachimedes, Pulp & Paper Canada, Vol. 80, No. 12, December 1979, T391-T395. There, for unbleached fibrous materials which were produced by various processes, the achievable strength level is given as a function of the yield and of the lignin content. As the lower limit of fibers which can be used for papermaking, the strength level is measured at 500 ml CSF (26° SR), and a comparative measurement is carried out for 300 ml CSF (41° SR) At yields of about 80%, breaking lengths of about 9-10 km at 500 ml CSF (26° SR) are achieved for spruce. The strength values increase with further beating. These already comparatively high values are achieved by pulping in the acid p13 range (bisulfite pulping, acid sulfite pulping). For fibers from neutral and alkaline pulping (neutral sulfite pulping, kraft and soda pulping), considerably lower strength values are indicated, which additionally have to be produced by a use of defibering and beating energy which is many times higher. This can be read from the higher numbers of revolutions of the PET beating unit which are needed to achieve a freeness of 500 ml CSF (26° SR) and 300 ml CSF (41° SR).

SUMMARY OF THE INVENTION

Starting from the outlined prior art, the invention provides an unbleached and a bleached fibrous material which offers a high strength level with a high lignin content of the fibers.

According to the embodiments of the invention, a lignocellulosic fibrous material has a breaking length of more than 8 km at 15° SR and a lignin content of at least 15%, based on the unbleached oven-dry fibrous material, for coniferous wood a tearing (breaking) length of more than 5.0 km at 20° SR and a lignin content of at least 12%, based on the unbleached oven-dry fibrous material, for deciduous wood.

DETAILED DESCRIPTION OF THE EMBODIMENTS OF THE INVENTION

The above-described fibrous material has a lignin content of at least 15%, based on the oven-dry fibrous material, for coniferous wood and of at least 12% for deciduous wood. This lignin content is determined by determining the Klason lignin and the acid-soluble lignin (definition of this, see further below). Klason lignin and acid-soluble lignin together give the lignin content of the respective fibrous material. The lignin content for deciduous woods is lower than the value for coniferous woods, since the latter have a higher initial lignin content. The lignin content of the fibrous material according to the invention can, however, quite possibly be higher for deciduous and coniferous woods, in particular more than 16%, more than 21% or more than 24% for coniferous wood. For deciduous woods, the values can be at least 14%, at least 16% or more than 16% lignin, based on the oven-dry fibrous material. The higher the lignin content of the fibrous material at the required tearing (breaking) length of more than 8 km at 15° SR for coniferous wood or at more than 5 km at 20° SR for deciduous wood, the lower are the losses of woody substance during production of the fibrous material. This increase in yield increases the competitiveness of the fibrous material.

The fibrous material according to the invention differs from the prior art in the fact that the fibers already exhibit high strength values at a freeness which is far lower than known fibers. The freeness is a measure of the dewatering behavior of a fiber suspension. Given a freeness of 12° SR or of 15° SR for coniferous wood, the fiber is changed only little morphologically. Known fibers with a high lignin content exhibit a structure at 15° SR which is not capable of making good bonds with adjacent fibers and therefore of building up an acceptable static strength level. However, the fibrous material according to the invention is capable of making good bonds with adjacent fibers even at a low freeness of 12° SR or of 15° SR, and therefore after little expenditure on beating energy.

The achievable strength values are more than 8 km for coniferous wood with a lignin content of at least 15%. Values of more than 9 km, of more than 9.5 km and—preferably—of more than 10 km tearing length at 15° SR in each case can readily be achieved for these fibrous materials. For deciduous wood with a lignin content of at least 12%, the achievable tearing length is often predefined by the type of wood. The values of 5.0 km at 20° SR represent the lower limit for deciduous woods. For instance, for poplar fibrous materials with a lignin content of more than 12%, tearing length values of more than 6 kin, preferably of more than 7 km, particularly preferably of more than 7.5 km at 20° SR in each case, have been measured.

However, the fibrous material according to the invention is not just distinguished by high tearing lengths. Instead, the strength level overall is high.

For example, the coniferous fibrous material according to the invention having a lignin content of more than 15% at 15° SR and based on a sheet weight of 100 g/m$^2$ exhibits a tear resistance of at least 65 cN. For deciduous fibrous material with a lignin content of mere than 12%, the tear resistance at 100 g/m2 sheet weight is at least 50 cN with a freeness of 20° SR.

This tear resistance, in conjunction with the high tearing lengths even at such unusually low freenesses of 15° SR for coniferous wood and 20° SR for deciduous wood is not known from the prior art. At the same time, with a high lignin content (more than 15% for coniferous wood and more than 12% for deciduous wood), the fibrous material exhibits an unusually high whiteness. Following pulping, that is to say without any bleaching treatment, values of 40% ISO and more are measured for coniferous wood, values of at least 60% ISO for deciduous wood. It is also readily possible to achieve values of more than 60% ISO for coniferous wood. Since the lignin is generally viewed as giving color to the fibrous material, it is noteworthy if such a whiteness is achieved despite the high lignin content.

If the fibrous material according to the invention is subjected to a bleaching treatment, then the fiber characteristics are improved considerably. The bleaching treatment is required in many applications with higher requirements on the whiteness; however, it is also aimed at adjusting and improving the fiber properties. The bleached fibrous material not only exhibits a considerably higher whiteness of more than 70% ISO, preferably of more than 75% 1SO for coniferous wood and of more than 60% ISO, preferably of more than 50% ISO for deciduous wood. With the bleaching treatment, the tearing lengths for coniferous wood are increased to more than 9 km, preferably to more than 9.5, particularly preferably to more than 10 km at 15° SR. During the bleaching treatment, the tear resistance for coniferous wood can be stabilized, as a rule improved. Following the bleaching, poplar fibrous materials at 20° SR have a tearing length of more than 7 km, preferably of note than 8 km. Beech fibrous materials following bleaching have a tearing length of more than 5.5 kin km, preferably of more than 6 km. The tear resistance is not changed substantially by the bleaching.

In the following text, production routes and significant properties of the fibrous material according to the invention will be explained in more detail by using exemplary embodiments.

The properties of the fibers were registered and measured in accordance with the following standards:

The yield was calculated by weighing the raw material used and the fibrous material obtained after the pulping or bleaching, in each case dried to constant weight at 105° C. (atro-oven-dry)

The lignin content was determined as Klason lignin in accordance with TAPPI T 222 om-98. The acid-soluble lignin was determined in accordance with TAPPI UM 250.

The whiteness was determined by producing the test sheets in accordance with Zellcheming Notesheet V/19/63; measurements were carried out in accordance with SCAN C 11:75 with a Datacolor Elrepho 450× photometer; the whiteness is specified in percent in accordance with ISO Standard 2470.

The opacity was determined in accordance with the stipulations of Zellcheming Notesheet VI/1/66.

The paper technological properties were determined on test sheets which were produced in accordance with Zellcheming Notesheet V/8/76.

Bulk density was determined in accordance with Zellcheming Instruction V/I/57.

Tearing length was determined in accordance with Zellcheming Instruction V/12/57.

The tear resistance was determined in accordance with DIN 53 128 Elmendorf. It is specified for a sheet having a sheet weight of 100 g/m$^2$.

The freeness was registered in accordance with Zellcheming Notesheet V/3/62.

The determination of tensile, tear and burst index was carried out in accordance with TAPPI 220 sp-96.

All statements of percentages in this document are percentages by weight unless otherwise indicated.

Examples 1-4

Production of Coniferous Fibrous Material

One possible way of producing the fibrous material according to the invention is described below: Spruce wood chips which were steamed for 30 minutes at 105° C. to 110° C. were treated with a total chemical use of 27.5% sodium sulfite (calculated as NaOH), based on oven-dry wood mass. A liquor ratio of 4:1 (chemical solution; oven-dry wood mass) was used. The pH was set to 9.4 at the start of pulping (Example 4). Pulping runs at lower initial pH values of 8 (Example 3), 7 (Example 2) or 6 (Example 1) were set to these lower initial pH values by adding $SO_2$.

During pulping in the liquid phase, the chips were heated up to a pulping temperature of 170° C. within 90 minutes and pulped for 180 minutes at this temperature. The free digestion liquor was drawn off and the chips defibered. The fiber composite was therefore broken down without acting mechanically on the individual fibers or the fiber surface. Far less energy was required to defiber the chips than in known processes for the production of high-yield chemical pulps. Less than 500 kWh/t of chips were sufficient to defiber the chemical pulp. The energy required was preferably less than 300 kWh/t of chips.

Table 1 Results of Examples 1-4, unbleached (shown at a freeness of 15° SR)

| Parameter | Examples 1 (initial pH 6) | 2 (initial pH 7) | 3 (initial pH 8) | 4 (initial pH 9.4) |
|---|---|---|---|---|
| Yield (%) | 87.0 | 78.5 | 82.1 | 79.3 |
| Lignin content | 24.4 | 22.0 | 23.0 | 22.2 |
| Whiteness (% ISO) | 55.6 | 61.7 | 60.5 | 57.6 |
| Tearing length (km) | 8.9 | 9.0 | 9.4 | 9.6 |
| Tear resistance (cN; 100 g/m$^2$) | 53.8 | 69.8 | 70.3 | 66.8 |

For the Examples 1-4 described above, the following results can be recorded:

The yield of more than 75% in each case, based on the wood mass originally used, corresponds to a fibrous substance having a lignin content of far more than 20%. The average lignin content for spruce wood is specified as 28%, based on the oven-dry wood mass (Wagenführ, Anatomie des Holzes [Anatomy or wood], VEB Fachbuchverlag Leipzig, 1980). The actual lignin content of the fibrous substance is higher since, during the pulping, it is predominantly but not exclusively lignin which is broken down. Carbohydrates (cellulose and hemicelluloses) are also dissolved in small quantities. The values specified show that the pulping exhibits good selectivity with regard to the breakdown of lignin and carbohydrate.

With values of more than 55% ISO, the whiteness is unexpectedly high and in this way offers a good starting basis for possible subsequent bleaching.

In order to beat the spruce fibrous materials of Examples 1 to 4 to a freeness of 15° SR, a beating period of 20 to 30 minutes was required. Up to a beating time of 20 minutes (freeness 12° SR-15° SR), the freeness developed within a narrow range, irrespective of the pH at the start of pulping (pH 6 to pH 9.4).

Likewise irrespective of the initial pH of the pulping and the beating time needed to reach the freeness, a high strength level was achieved at a freeness of 15° SR. Example 1 led to a strength level which is overall high with a breaking length of 8.9 km and a tear resistance of 53.3 cN. However, if the initial pH was 7 or more, the tearing length rose to 9 km and more. The tear resistance reaches values of 65 cN and more.

Examples 5 and 6

Production of Deciduous Fibrous Materials

Beech or poplar chips were in each case steamed for 30 minutes at 105° C. to 110° C. The beech chips were then treated with 22.5% sodium sulfite (calculated as NaOH), based on the oven-dry wood mass used, with a liquor ratio of chemical solution: wood=4:1. The poplar chips were treated with 20% sodium sulfite, based on the oven-dry wood mass, with a liquor ratio of 4:1.

For pulping both types of wood were heated up to the pulping temperature of 170° C. in 90 minutes. The pulping period was 60 minutes at maximum temperature for beech and 30 minutes at maximum temperature for poplar. The free digestion solution was drawn off and the chips were defibered, which means that the fiber composite was dissolved, without acting in a beating manner on the individual fibers or fiber surface.

The results of these pulping runs are shown by Table 2. The beech and poplar fibrous materials were defibered with a minimum of energy (less than 300 kWh/t). Even after a few minutes, they reached extremely high freenesses. More than 15° SR was measured even without beating. The deciduous fibrous materials were therefore analyzed at a freeness of 20° SR.

The yield was around 75% and more, based on the oven-dry chips. Here, too, the good selectivity of the pulping according to the invention was exhibited.

The fibrous materials produced in this way already exhibited an extremely high whiteness, which was more than 65% ISO, despite the high yield. This therefore provided a good basis for possible subsequent bleaching.

With a tearing length of more than 5 km at 20° SR, the beech exhibited a tearing length which is considerable for this type of wood. The tear resistance was more than 50 cN. The strength level for the poplar fibrous material was even higher. A tearing length of more than 7.5 km and a tear resistance of 65 cN at 20° SR are not known for deciduous fibrous materials with a high lignin content.

TABLE 2

Results of Examples 5, 6, unbleached (shown at a freeness of 20° SR)

| Parameter | Examples 5 (beech) | 6 (poplar) |
|---|---|---|
| Yield (%) | 75.0 | 79.0 |
| Lignin content | 17.0 | 17.1 |
| Whiteness (% ISO) | 69.7 | 67.8 |
| Tearing length (km) | 5.3 | 7.7 |
| Tear resistance (cN; 100 g/m$^2$) | 53.1 | 65.0 |

Bleach Treatment

The coniferous fibrous material produced as described previously was bleached in order to increase the whiteness. The brightening should be carried out with the lowest possible yield losses. What was attempted was, therefore, lignin-maintaining bleaching. As a rule, bleaching was carried out in a number of stages. The reaction conditions for the various bleaching treatments will be explained below:

Q Stage

By means of a complexing agent, the heavy metal content of the fibrous material was reduced. The fibrous material was adjusted to a pH of 5-5.2 with 4N sulfuric acid at 3% consistency and treated with 0.2% DTPA for 30 minutes at 60° C.

P Stage

The P stage was carried out with hydrogen peroxide as bleaching agent. At a consistency of 10%, bleaching was carried out at 80° C. over 240 minutes with the addition of 5% hydrogen peroxide, based on oven-dry fibrous material, and the addition of 2.5% NaOH, 3% silicate and 0.1% magnesium sulfite (in each case based on oven-dry fibrous material. The pH was measured as 11 at the start, 9.7 at the end of the bleaching. Washing was then carried out.

Formamidine Sulfinic Acid (FAS) Stage

The FAS stage is based on FAS as a way of brightening the fibrous material. The bleaching was carried out at high temperature (99° C.) over 30 minutes at a consistency of 12%. 1% FAS, 0.5% NaOH and 0.5% silicate were added, in each case based on oven-dry fibrous material.

Fiber Properties

Following defibering, the pulping results were registered, in particular yield, lignin content, tearing length, tear resistance and whiteness of the fibrous material. In order to obtain the most complete picture of the properties of the fibers, parts of the fibrous material were beaten for 15, 30, 45 and 60 minutes.

Example 1

(Fibrous Material Pulped at pH 6), Bleached

After pulping, the fibrous material was bleached with a sequence Q P FAS. With an overall yield following bleaching of 82% (based on the oven-dry chips at the start of pulping), it had a lignin content of 24%, based on the oven-dry fiber mass. The whiteness at the end of the bleaching sequence was measured as 77% ISO.

The tearing length at 15° SR was 8.86 km, the tear resistance was 60.1 cN. The opacity was measured as 68.3, based on a sheet weight of 80 g/m$^2$. If beating is continued, the tearing length increases further, tear resistance and opacity decrease.

Example 2

(Fibrous Material Pulped at pH 7), Bleached

For this pulping run, a yield (unbleached) of 78.5%, based on oven-dry wood chips, and a whiteness of 61.7% ISO were measured. The lignin content of the fibers was determined as 20%, based on the oven-dry fiber mass (cf. Table 1). The tearing length at 15° SR was 8.97 km, the tear resistance 69.8 cN and the opacity was measured as 82.2%.

The whiteness of the bleached fibrous material was measured as 76.7% ISO. The bleaching sequence was Q P FAS. The overall yield, based on the spruce chips used, was 74.3%. The lignin content of the bleached fibers was 17.8%, based on the oven-dry fiber mass of the bleached fibers.

The tearing length of this bleached fibrous material was measured as 9.34 km at 15° SR, the tear resistance as 56.6 cN. The opacity was determined as 71.2%.

Example 3

(Fibrous Material Pulped at pH 8), Bleached

Following the pulping of the spruce chips, a yield of 82.1%, based on the oven-dry chips at the start of pulping, and a lignin content of 21.4%, based on the unbleached even-dry fiber mass, were determined. The whiteness was measured as 60.5% ISO. The tearing length at 15° SR was determined as 9.36 km, the tear resistance as 70.3 cN and the opacity as 81.1%

For the bleached fibrous material, a whiteness of 75.7% ISO and a yield of 77.4%, based on oven-dry spruce chips, were determined. A lignin content of 19.3% was measured for the bleached oven-dry fiber mass.

The tearing length of the bleached spruce fiber material was measured as 10.5 km at 15° SR, the tear resistance as 70.2 cN and the opacity as 66.8%.

Example 4

(Fibrous Material Pulped at pH 9.4), Bleached

The whiteness of the unbleached fibrous material was measured as 57.6% ISO. The yield was determined as 79.3%, based on the oven-dry spruce chips used. The lignin content was 19.9% of the unbleached oven-dry fiber mass. The tearing length of the fibrous material at 15° SR was 9.64 km, the tear resistance 66.8 cN and the opacity was measured as 79.9.

For the bleached fibrous material, a whiteness of 75.1% ISO was measured, the yield was 75.1%, based on the oven-dry spruce chips originally used. For the bleached fiber mass, a lignin content of 17.7% was measured, based on the oven-dry fiber mass.

The tearing length at 15° SR was 10.58 km the tear resistance 70.7 cN and the opacity was 66%.

In relation to the trial results described above, it is generally to be recorded that the bleached fibrous materials have slightly improved strength properties as compared with the unbleached stocks, without excessive yield losses having to be recorded. Overall, the fibrous material behaves very positively in the bleaching, and, together with the increase in whiteness achieved, a good strength level and a yield that is good overall are to be recorded, based on the quantity of oven-dry chips originally used.

It should be noted that the spruce fibrous materials investigated could be defibered with very little beating energy and beaten to a freeness of 15° SR. The unbleached fibrous materials—as to be expected—had to be beaten with somewhat more effort than the bleached fibrous materials. The beating energy for achieving 15° SR for unbleached spruce fibrous materials was less than 500 kWh/t of fibrous material.

Example 5

(Beech Fibrous Material Pulped at pH 9.4), Bleached

Beech chips were pulped with an initial pH of 9.4. The digested fibrous material could be beaten extraordinarily easily and with very little beating energy. The fibrous material properties were determined at 20° SR.

The whiteness of the unbleached stock was measured as 69.7% ISO, the yield was 75.0% of the total quantity of oven-dry chips used. The lignin content of the beech fibrous material—starting from an average lignin content for beech of 22%—was determined as 16.5%, based on the unbleached oven-dry beech fiber mass. The tearing length at 20° SR was measured as 5.25 km, the tear resistance as 53.1 cN and the opacity for a sheet weight of 80 g/m$^2$ as 85.3%.

For the bleached beech fibrous material, the tearing length, measured at 20° SR, was over 6 km. The tear resistance did not change significantly.

Example 6

(Poplar Fibrous Material Pulped at pH 9.4), Bleached

The unbleached poplar fibrous material was also analysed at 20° SR. The whiteness was measured as 67.8% ISO, the yield was 79.0%, based on the oven-dry poplar chips used. The lignin content of the poplar fibrous material—starting from an average lignin content for poplar of 20%—was determined as 15%, based on the unbleached oven-dry poplar fiber mass. The tearing length at 20° SR was measured as 7.72 km, the tear resistance as 65.0 cN and the opacity was determined as 80.0%.

The tearing length of the bleached poplar fibrous material at 20° SR was measured as about 8.3 km, the tear resistance not having changed significantly as a result of the bleaching.

Example 7

Spruce Fibrous Material, Unbleached

The fibrous material according to Example 7 was produced from spruce chips under the conditions of Example 1, with the following changes: in addition to the 27.5% total chemicals (sulfite and NaOH in the predefined ratio), 0.1% anthraquinone, based on the quantity of wood used, was added to the chemical solution. The duration of the pulping was shortened to 45 minutes.

Example 8

Spruce Fibrous Material, Unbleached

As Example 7 but with a total chemical use of 25%, based on the quantity of oven-dry wood used, and a pulping time of 50 minutes.

TABLE 3

Results of Examples 7-11, unbleached (shown at a freeness of 15° SR)

| Parameter | Examples 7 | 8 | 9 | 10 | 11 | 12 |
|---|---|---|---|---|---|---|
| Yield (%) | 76.7 | 76.2 | 77.1 | 76.6 | 77.5 | 81.1 |
| Lignin content | 21.5 | 21.3 | 21.6 | 21.5 | 21.7 | 22.7 |
| Whiteness (% ISO) | 53.1 | 56.7 | 51.4 | 52.4 | 52.9 | 53.7 |
| Tearing length (km) | 11.0 | 10.1 | 10.4 | 10.1 | 10.1 | 9.6 |
| Tear resistance (cN; 100 g/m$^2$) | 78.2 | 76.1 | 75.7 | 73.8 | 78.3 | 75.0 |

Example 9

Spruce Fibrous Material, Unbleached

As Example 7 with a total chemical use of 22.5% and a pulping time of 50 minutes.

Example 10

Spruce Fibrous Material, Unbleached

As Example 7 but with a total chemical use of 20% and a pulping time of 55 minutes.

Example 11

Spruce Fibrous Material, Unbleached

As Example 7 but with a total chemical use of 17.5% and a pulping time of 55 minutes.

Example 12

Spruce Fibrous Material, Unbleached

As Example 7 but with a total chemical use of 15% and a pulping time of 60 minutes.

What is initially striking is that, by adding 0.1% anthraquinone, the time for the pulping, as compared with 180 minutes in the case of Example 1, can be reduced by 135 minutes (75% of the pulping time) to 45 minutes under otherwise unchanged pulping conditions. The results of the pulping runs are comparable, as illustrated in Table 4. This gain in time is valuable, primarily because the plants for fibrous material production can be dimensioned to be smaller. Further potential savings reside in the fact that the temperature needed for the pulping has to be maintained only over a very much shorter time period.

TABLE 4

Results of Examples 4 and 7, unbleached (shown at a freeness of 15° SR)

| Parameter | Examples 4 | 7 |
|---|---|---|
| Yield (%) | 79.3 | 76.7 |
| Lignin content | 22.2 | 21.6 |
| Whiteness (% ISO) | 57.6 | 53.1 |
| Tearing length (km) | 9.6 | 11.0 |
| Tear resistance (cN; 100 g/m$^2$) | 66.8 | 78.2 |
| Pulping time (min) | 180 | 45 |

Furthermore, it can be gathered from the data of Table 3 that, with a reduction in the total use of chemicals from 27.5% to 15%, fibrous material with largely equally good properties is produced. These results do not depend on the use of the anthraquinone. The anthraquinone has the effect of accelerating the pulping but the desired fibrous material can also be pulped without the addition of anthraquinone. For each of the pulping examples, the whiteness is more than 50% ISO and the lignin content in Examples 7 to 11 moves between 21.5% and 22%, based on oven-dry fibrous material. The tearing length is more than 10 km and the tear resistance was measured as more than 70 cN, as a rule more than 75 cN at 15° SR.

The bleaching of the fibrous material according to Example 12 leads to the following results: After the Q stage, the whiteness stagnates at 52.2% ISO. The yield of this stage is 99.3%, based on oven-dry fiber mass.

The P stage leads to an increase in whiteness to 64.3% ISO with a yield of 97.1%, based on oven-dry fiber mass. The FAS stage brings a further increase in whiteness to 75.1% ISO with a yield of 98.9%, based on oven-dry fiber mass. The increase in whiteness overall amounts to 21.3% ISO with a total yield of 77.3%, based on the oven-dry wood mass used at the beginning.

The pulping runs explained below according to Examples 13 to 16 relate to steam-phase pulping runs.

Example 13

Spruce Fibrous Material Produced in the Steam Phase, Unbleached

Spruce wood chips were impregnated with 27.5% use of chemicals with a liquor ratio of wood chemical solution=1:5 at 120° C. in the steam phase for 120 minutes. The chemicals used were sulfite and 0.1% anthraquinone. At the start of the impregnation, a pH of 9.4 was established. Following the impregnation, the chemical solution was removed.

The chips impregnated with the chemical solution were heated to 170° C. in about 5 minutes with steam. This steam phase at 170° C. was maintained over 60 minutes. The steam was then let out and the digester was cooled to 100° C. within 30 seconds and ambient pressure was established. The chips were removed from the digester and defibered. Partial quantities of the spruce fibrous material produced in this way were beaten and freeness and fibrous material properties were determined for the beaten partial quantities.

Example 14

Spruce Fibrous Material, Produced in the Steam Phase, Unbleached

As Example 13 but with a pulping time in the steam phase of 45 minutes. The chemical use was increased to 63.0%, based on the oven-dry quantity of wood.

Example 15

Spruce Fibrous Material Produced in the Steam Phase, Unbleached

As Example 14 but with a pulping time of 30 minutes.

Example 16

Spruce Fibrous Material Produced in the Steam Phase, Unbleached

As Example 14 but with a pulping temperature of 170° C.

TABLE 5

Results of Examples 13-16, unbleached (shown at a freeness of 15° SR)

| Parameter | Examples 13 | 14 | 15 | 16 |
|---|---|---|---|---|
| Yield (%) | 78.3 | 71.1 | 75.9 | 83.1 |
| Lignin content | 21.9 | 19.9 | 21.3 | 23.3 |
| Whiteness (% ISO) | 32.2 | 39.1 | 43.1 | 49.2 |
| Tearing length (km) | — | 11.0 | 10.0 | — |
| Tear resistance (cN; 100 g/m$^2$) | — | 91.0 | 82.2 | — |

The pulping runs in the steam phase show a low overall time requirement. As compared with the pulping in the liquid phase, the heating up to the maximum pulping temperature is carried out very much more quickly. The actual pulping then needs the same time as digestion in the liquid phase. During the steam-phase pulping, there is no free-flowing chemical solution; this is drawn off following the impregnation and before the pulping. It is therefore mixed less with organic material than the chemical solution, which is drawn off after pulping in the liquid phase. However, this has no significant influence on the quality of the fibrous material produced.

The yield of the pulping runs in the liquid phase with the addition of anthraquinone, illustrated in Table 3, is above 75%, based on the oven-dry quantity of wood. For the steam-phase pulping runs, this was likewise achieved, with the exception of Example 14. The whiteness of the fibrous materials produced in Examples 13 to 16 is, however, considerably lower than Examples 7 to 12. From only 32.2% ISO in the steam-phase pulping with a maximum pulping time of 60 minutes, the whiteness rises to 39.1% ISO when the pulping is shortened to 45 minutes. A further reduction in the pulping time to 30 minutes leads to an increase to 43.1% ISO. A significant effect is brought about by reducing the maximum pulping temperature from 170° C. to 155° C.; the whiteness rises to 49.1% ISO.

The fibrous materials produced in the steam phase exhibit excellent strengths. The tearing length was measured as 10 km (Example 15) and as 11 km (Example 14) at 15° SR. The tear resistance was measured as 62.0 cN (Example 15) and as 91.0 cN (Example 14). These values Correspond to the best values which were reached for pulping runs in the liquid phase or are still higher. Comparable strength values are not known for fibrous materials from the prior art.

Surprisingly, during the bleaching of a fibrous material pulped in the steam phase, it emerges that the low initial whiteness does not represent any obstacle to the requirements for use. Here, too, the Q stage does not effect any significant change in whiteness. However, the P stage results in a rise in whiteness of about 20% ISO to 63.4% ISO. Here, the fibrous material is already moving to the same whiteness level exhibited after the P stage by the fibrous materials pulped in the liquid phase. Following the completion of the FAS stage, a whiteness of 74.0% ISO was measured, which likewise coincides with the results which were measured from the fibrous material pulped in the liquid phase. The total yield following completion of the bleaching sequence Q P FAS is 71.6%, based on the oven-dry wood mass originally used. The increase in whiteness as a result of the bleaching is more than 30% ISO.

The following Tables 6 and 7 are intended to illustrate the fact that the fibrous materials produced in accordance with the invention already offer good strength properties at freenesses of 12° SR. From these tables, it can be gathered particularly clearly that the fibrous materials according to the invention need only little expenditure of energy during beating in order to build up high tearing lengths, without the tear resistance being reduced. 12° SR freeness was in each case reached in 0-10 minutes; 130 SR in 5-30 minutes, normally 10-20 minutes. In order to reach 14° SR, the Jokro mill had to operate for 30-40 minutes, and for 15° SR 35 to 40 minutes were required. It is obvious that beating to a freeness around 40° SR would require an enormous expenditure of beating energy. One particular advantage of the process according to the invention can therefore be seen in the fact that fibrous materials that can be beaten with little expenditure of energy are produced.

TABLE 6

Tearing length (km) for Examples 7-12, shown at various freenesses

| Tearing length (km) at freeness | Examples 7 | 8 | 9 | 10 | 11 | 12 |
|---|---|---|---|---|---|---|
| 12° SR | 7.3 | 6.9 | 7.3 | 6.8 | 8.7 | 8.1 |
| 13° SR | 9.5 | 9.8 | 9.3 | 8.6 | 9.6 | 9.0 |
| 14° SR | 10.5 | 10.1 | 10.1 | 10.2 | 9.9 | 9.2 |
| 15° SR | 11.0 | 10.1 | 10.4 | 10.1 | 10.1 | — |

TABLE 7

Tear Resistance (cN; 100 g/m$^2$) for Examples 7-12, shown at various freenesses

| Tearing length (km) | Examples | | | | | |
|---|---|---|---|---|---|---|
| at freeness | 7 | 8 | 9 | 10 | 11 | 12 |
| 12° SR | 115.1 | 113.1 | 108.0 | 98.8 | 96.4 | 87.9 |
| 13° SR | 82.6 | 80.3 | 86.3 | 90.5 | 90.1 | 77.0 |
| 14° SR | 80.5 | 78.5 | 76.6 | 72.6 | 84.3 | 72.8 |
| 15° SR | 78.2 | 76.1 | 75.7 | 73.8 | 78.3 | — |

At a freeness of 12° SR, the tearing length has already been well developed as more than 6.5 km for spruce fibrous material. The increase in tearing length decreases with each further level of freeness; at 14° SR to 15° SR the strength potential of the fibers is substantially exhausted.

The invention claimed is:

1. A wood-based lignocellulosic fibrous material comprising:

an oven-dry fibrous material of coniferous wood in an unbleached state having a breaking length of more than 6.5 km at 12° SR and a lignin content of at least 15%; and an oven-dry fibrous material of deciduous wood in an unbleached state having a breaking length of more than 5.0 km at 20° SR and a lignin content of at least 12%.

2. The wood-based lignocellulosic fibrous material in accordance with claim 1, wherein the oven-dry fibrous material of coniferous wood has a breaking length of more than 8.0 km at 15° SR.

3. The wood-based lignocellulosic fibrous material in accordance with claim 1, wherein the lignin content of the oven-dry fibrous material of coniferous wood is at least 18%, and in that the lignin content of the oven-dry fibrous material of deciduous wood is at least 14%.

4. The wood-based lignocellulosic fibrous material in accordance with claim 1, wherein the lignin content of the oven-dry fibrous material of coniferous wood is at least 21%, and in that the lignin content of the oven-dry fibrous material of deciduous wood is at least 16%.

5. The wood-based lignocellulosic fibrous material in accordance with claim 1, wherein the lignin content of the oven-dry fibrous material of coniferous wood is at least 24%, and in that the lignin content of the oven-dry fibrous material of deciduous wood is at least 18%.

6. The wood-based lignocellulosic fibrous material in accordance with claim 1, wherein the breaking length for the oven-dry fibrous material of coniferous wood at 12° SR is more than 7 km.

7. The wood-based lignocellulosic fibrous material in accordance with claim 1, wherein the breaking length for the oven-dry fibrous material of coniferous wood at 12° SR is more than 7.5 km.

8. The wood-based lignocellulosic fibrous material in accordance with claim 1, wherein the breaking length for the oven-dry fibrous material of coniferous wood at 12° SR is more than 8 km.

9. The wood-based lignocellulosic fibrous material in accordance with claim 1, wherein the breaking length for the oven-dry fibrous material of coniferous wood at 15° SR is more than 9 km.

10. The wood-based lignocellulosic fibrous material in accordance with claim 1, wherein the breaking length for the oven-dry fibrous material of coniferous wood at 15° SR is more than 9.5 km.

11. The wood-based lignocellulosic fibrous material in accordance with claim 1, wherein the breaking length for the oven-dry fibrous material of coniferous wood at 15° SR is more than 10 km.

12. The wood-based lignocellulosic fibrous material in accordance with claim 1, wherein the breaking length for the oven-dry fibrous material of deciduous wood is more than 6 km.

13. The wood-based lignocellulosic fibrous material in accordance with claim 1, wherein the breaking length for the oven-dry fibrous material of deciduous wood is more than 7 km.

14. The wood-based lignocellulosic fibrous material in accordance with claim 1, wherein the breaking length for the oven-dry fibrous material of deciduous wood is more than 7.5 km.

15. The wood-based lignocellulosic fibrous material in accordance with claim 1, wherein the oven-dry fibrous material of the coniferous wood has a whiteness of at least 40% ISO and the oven-dry fibrous material of the deciduous wood has a whiteness of at least 60% ISO.

16. The wood-based lignocellulosic fibrous material in accordance with claim 1, wherein the oven-dry fibrous material of coniferous wood has a tear resistance, at a sheet weight of 100 g/m$^2$, of at least 65 cN at 15° SR, and the oven-dry fibrous material of deciduous wood has a tear resistance, at a sheet weight of 100 g/m$^2$, of at least 50 cN at 20° SR.

* * * * *